United States Patent [19]

Stafford et al.

[11] Patent Number: 4,644,706

[45] Date of Patent: Feb. 24, 1987

[54] BUILDING STRUCTURE WITH TRANSVERSELY TENSIONED FABRIC COVERING

[76] Inventors: Robert Stafford, 3017 Clay St., Newport Beach, Calif. 92663; Gregory J. Cook, 3611 - 36th St., San Diego, Calif. 92104

[21] Appl. No.: 822,328

[22] Filed: Jan. 27, 1986

[51] Int. Cl.[4] ..... E04B 1/32

[52] U.S. Cl. ..... 52/63; 52/86; 135/102

[58] Field of Search ..... 52/63; 135/102, DIG. 1, 135/DIG. 5, 119; 256/37, 40, 41, 42, 43, 44; 273/29 BC, 29 BD, 29 BE

[56] References Cited

U.S. PATENT DOCUMENTS

| | | | |
|---|---|---|---|
| 3,513,608 | 5/1970 | Nagrod | 52/222 |
| 3,780,477 | 7/1971 | Sprung, Jr. | 52/86 |
| 3,802,450 | 4/1974 | Huddle | 135/102 |
| 3,872,634 | 3/1975 | Seaman | 52/222 |
| 3,940,139 | 2/1976 | Barnes | 273/29 B |
| 3,973,364 | 10/1975 | Seaman | 52/57 |
| 4,028,861 | 6/1977 | Huddle | 135/102 |
| 4,036,244 | 6/1975 | Huddle . | |
| 4,065,906 | 6/1976 | Mears | 52/745 |
| 4,092,992 | 6/1978 | Huddle | 135/102 |
| 4,096,669 | 6/1978 | Pabst | 135/119 |
| 4,118,904 | 6/1977 | Sprung | 52/63 |
| 4,121,604 | 10/1978 | Rain | 135/102 |
| 4,137,687 | 2/1979 | Sprung | 52/222 |
| 4,188,756 | 12/1977 | Ljungbo | 52/83 |
| 4,290,243 | 9/1981 | Mellin | 52/63 |
| 4,404,980 | 9/1980 | Wade | 135/102 |

FOREIGN PATENT DOCUMENTS

| | | | |
|---|---|---|---|
| 179434 | 1/1954 | Austria | 256/40 |

*Primary Examiner*—John E. Murtagh

*Attorney, Agent, or Firm*—Baker, Maxham & Jester

[57] ABSTRACT

A plurality of arches are supported in longitudinally spaced, transversely extending, vertical positions. A plurality of fabric panels are each connected between a corresponding pair of adjacent arches. A pair of arcuately extending cables are connected to corresponding opposite end portions of each fabric panel so that the ends of the cables terminate adjacent the lower ends of the corresponding arches. A plurality of base mechanisms are each attached to and support a lower end of a corresponding arch. The opposite ends of each cable are threaded through and guided by adjacent base mechanisms so that they can be pulled together with a winch to transversely tension the corresponding fabric panel.

9 Claims, 12 Drawing Figures

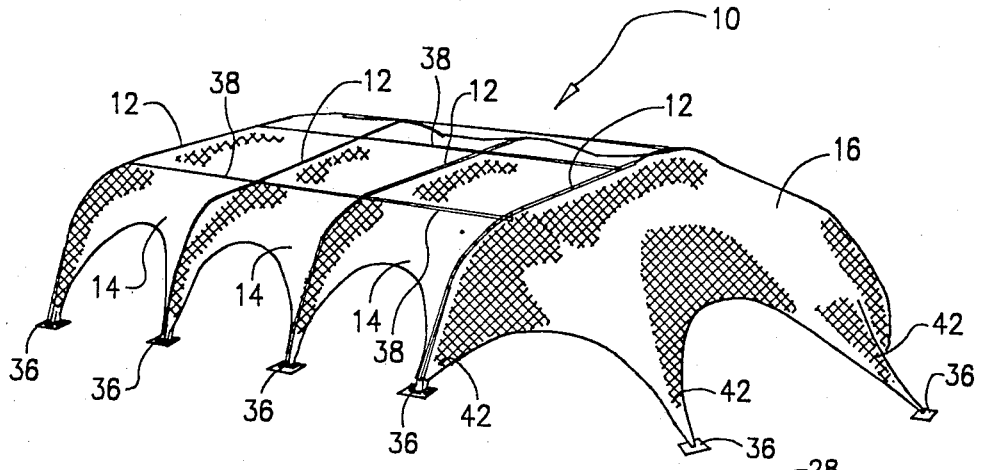
FIG. 1
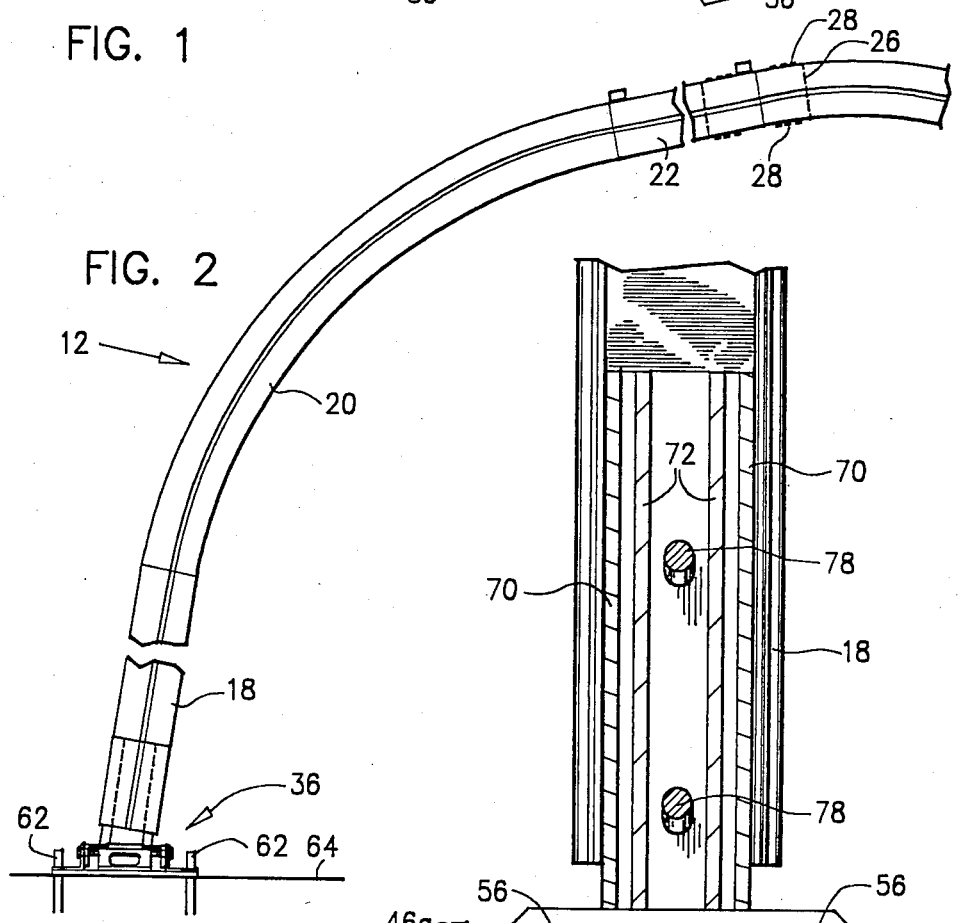
FIG. 2
FIG. 3

FIG. 4
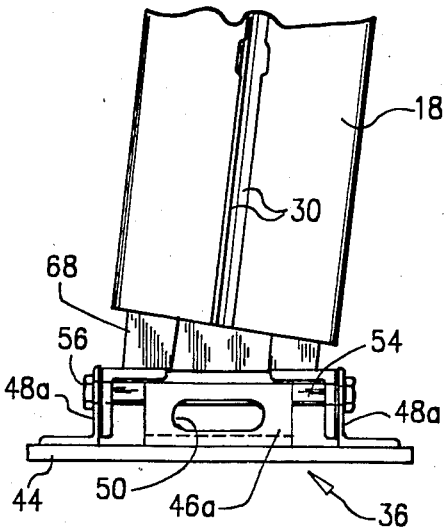
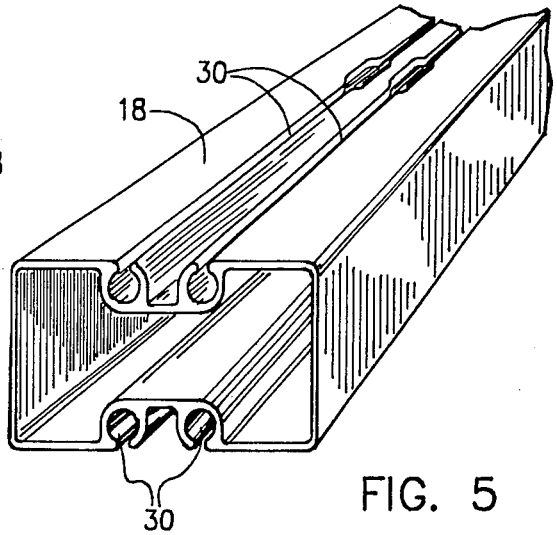
FIG. 5
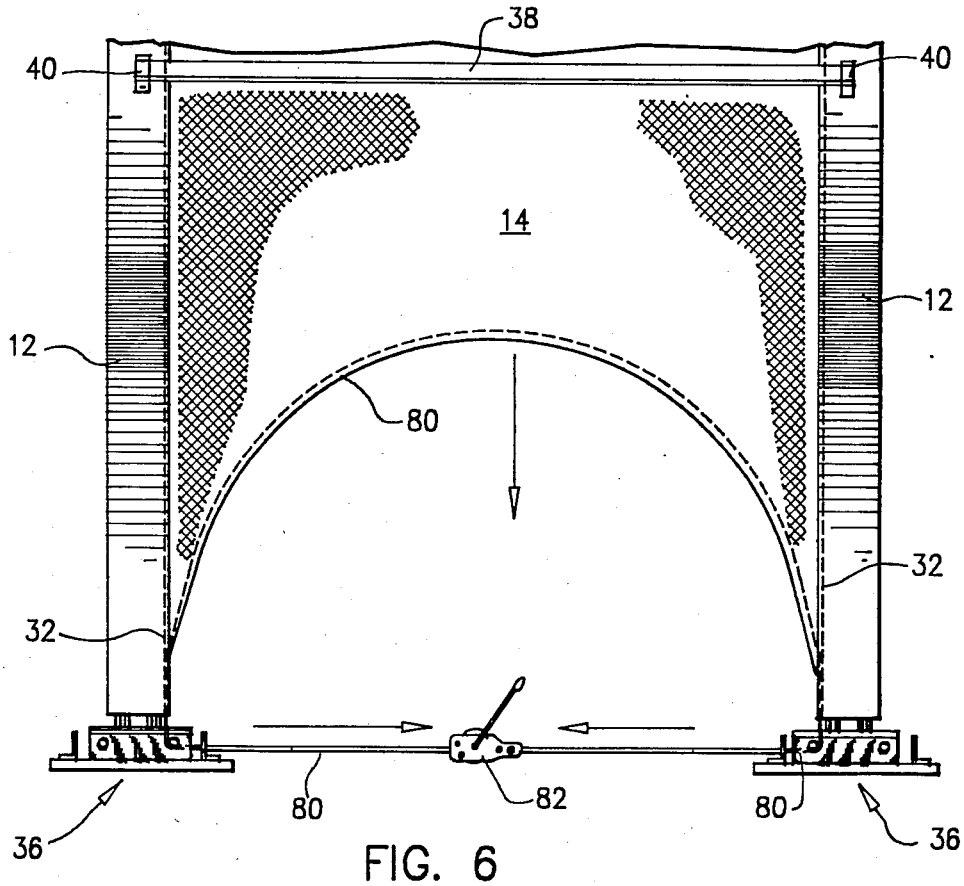
FIG. 6

BUILDING STRUCTURE WITH TRANSVERSELY TENSIONED FABRIC COVERING

BACKGROUND OF THE INVENTION

The present invention relates to building structures, and more particularly, to building structures of the type in which fabric or other web material is stretched over a frame to provide an interior sheltered from the outside environment.

Fabric covered structures in one form or another have been around for thousands of years. Ancient fabric structures took many forms, from very primitive teepees to Arabic palaces. Today, most individuals are familiar with circus tents and tents used for camping.

The need for relatively inexpensive, portable, rapidly erected building structures has led to the development of fabric covered frame structures able to handle forty pounds of snow per square foot, winds up to one hundred and twenty miles per hour, and having insulation, heating and cooling comparable to permanent building structures of wood, masonry, concrete or steel.

Building structures have heretofore been developed which have included a plurality of transverse arches with individual fabric panels stretched therebetween. The fabric panels have been stretched by separating the arches and/or pulling transversely on the ends of the panels. Efficient mechanisms for accomplishing transverse stretching of fabric panels have not been provided.

SUMMARY OF THE INVENTION

It is therefore the primary object of the present invention to provide an improved fabric covered frame structure.

It is another object of the present invention to provide such a structure having a plurality of transversely extending arches, a plurality of fabric panels connected between adjacent pairs of the arches, and improved means for transversely stretching the fabric panels.

Another object of the present invention is to provide such a structure which may be rapidly assembled with a minimum amount of connectors and other hardware.

Another object of the present invention is to provide such a structure which has inner and outer fabric skins to provide better thermal insulation.

Another object of the present invention is to provide such a structure which has a durable construction.

Another object of the present invention is to provide such a structure which is aesthetically appealing due to the fact that the fabric panels are tensioned transversely to make them curved, depressed, and wrinkle-free between the arches.

Another object of the present invention is to provide a novel base connection mechanism for mounting the lower ends of the arches.

According to the illustrated embodiment of the present invention, a plurality of arches are supported in longitudinally spaced, transversely extending, vertical positions. A plurality of fabric panels are each connected between a corresponding pair of adjacent arches. A pair of arcuately extending cables are connected to corresponding opposite end portions of each fabric panel so that the ends of the cables terminate adjacent the lower ends of the corresponding arches. A plurality of base mechanisms are each attached to and support a lower end of a corresponding arch. The opposite ends of each cable are threaded through and guided by adjacent base mechanisms so that they can be pulled together with a winch to transversely tension the corresponding fabric panel.

BRIEF DESCRIPTION OF THE DRAWINGS

FIG. 1 is a perspective view of a preferred embodiment of our building structure fully erected.

FIG. 2 is an enlarged, fragmentary side elevation view of a portion of one of the arches of the building structure of FIG. 1 with a base mechanism attached to its illustrated lower end.

FIG. 3 is an enlarged front view of the connected arch and base mechanism, with portions sectioned, taken from the left hand side of FIG. 2.

FIG. 4 is an enlarged side elevation view of the connected arch and base mechanism.

FIG. 5 is an end perspective view of a portion of one of the arches.

FIG. 6 is a side elevation view illustrating the tensioning of a fabric panel between a pair of adjacent arches of the building structure of FIG. 1.

DESCRIPTION OF THE PREFERRED EMBODIMENT

Figure 7:
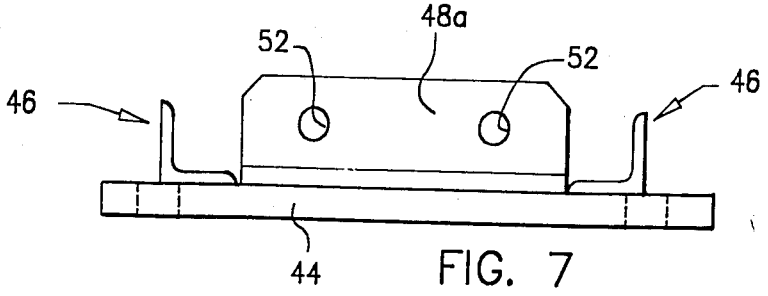
FIGS. 7 and 8 are enlarged front and side elevation views, respectively, of a base which forms part of each of the base mechanisms.

The entire disclosure of U.S. Pat. No. 4,593,710 granted June 10, 1986 and entitled "Framed Tension Structure" is specifically incorporated herein by reference.

Referring to FIG. 1, the illustrated embodiment 10 of our building structure includes a plurality of arches 12 which are supported in longitudinally spaced, transversely extending, vertical positions. A plurality of panels 14 made of a web material are each connected between a corresponding pair of adjacent arches 12. End sections 16 of the same web material are attached between the outermost arches 12 and the ground to form end closures. One suitable high strength, durable web material is coated or laminate polyester vinyl chloride (PVC). By way of example, the laminate PVC may be rated at eighteen ounces per square foot and the coated PVC may be rated at twenty-two ounces per square foot.

Referring to FIGS. 2 and 5, each arch 12 comprises a plurality of hollow extruded aluminum box beam segments such as 18, 20, 22, and 24 which are joined end-to-end. The shapes of the box beam segments, i.e. straight, slightly curved, etc., are selected to achieve both the span, pitch and profile of the building suited to the particular usage, snow load, and other design parameters. Steel moment splices 26 (FIG. 2) fit within adjacent ends of mating box beam segments and are held in position with bolts 28. The other moment splices are not illustrated in FIG. 2 for the sake of clarity.

Referring to FIG. 5, each box beam segment, such as 18, is formed with pairs of longitudinally extending, outwardly opening rounded slots 30 on opposite sides thereof. The transverse edges of the fabric panels 14 and end sections 16 have NYLON ropes 32 (FIG. 6) stitched, hemmed or otherwise connected thereto as disclosed in the aforementioned U.S. Pat. No. 4,593,710. These ropes have a length and diameter such that they can be snugly threaded through corresponding ones of the slots 30 to attach the edges of the panels and sections to corresponding ones of the arches 12. Each slot has a flared opening 34 communicating therewith in at least one of the box beam segments in each arch. This flared opening permits the rope of a panel or end section edge to be threaded into the corresponding slot after the lower ends of the arches are mounted to respective base mechanisms 36 (FIG. 2). The ropes 32 are illustrated in phantom lines in FIG. 6 since they are hidden from view. The twin slots 30 are opposite sides of each arch permit upper and lower spaced apart fabric panels (not illustrated) to be attached between each adjacent pair of arches to thereby provide greater thermal insulation.

Referring to FIGS. 1 and 6, the arches 12 are rigidly connected by horizontally extending purlins 38. These may also be made of extruded aluminum. The opposite ends of the purlins are received in, and bolted to, steel saddles 40. The saddles are in turn bolted to the upper sides of the arches 12 at spaced locations therealong. The purlins 38 are mounted above the fabric panels 14.

Figure 8:
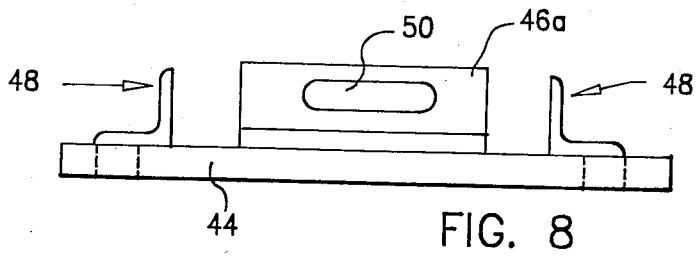
Figure 9:
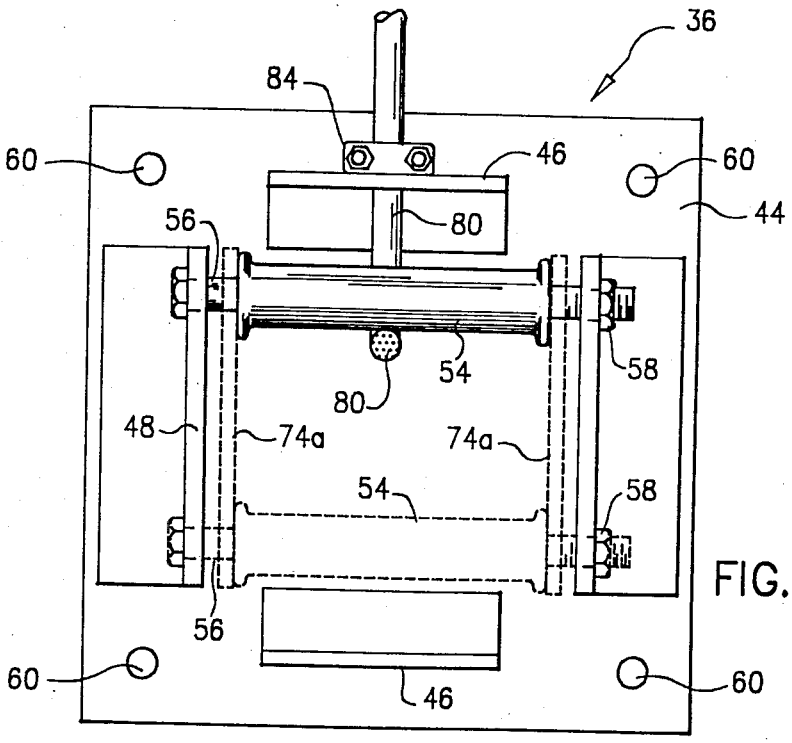
FIG. 9 is an enlarged top plan view of the base illustrating the positions of its parallel cable guide rollers. Also illustrated is a terminal end of one of the arcuate cables threaded around one of the rollers and secured with a clamp.

FIG. 9 is a plan view of one of the base mechanisms 36 that is used to support a corresponding lower end of each of the arches. In addition, the base mechanisms are also used in tying down the respective downward apexes 42 (FIG. 1) of the end fabric sections 16. The base mechanism 36 (FIG. 9) includes a horizontal metal base plate 44 and spaced pairs 46 and 48 of L-shaped members welded thereto. Each of the L-shaped members defines an upstanding flange. Referring to FIGS. 7 and 8, the flanges **46*a* have elongate apertures 50 and the flanges 48*a* have spaced apart holes 52. A pair of guide rollers 54 (FIG. 9) are each journaled on respective bolts 56 between the L-shaped members 48. The ends of the bolts 56 are received in the corresponding holes 52 in the L-shaped members 48. Nuts 58 are secured over the ends of the bolts 56 to hold them in place. Holes 60 are provided in each of the four corners of the plate 44 for receiving pins such as 62 which are hammered into the ground or otherwise secured into a foundation 64**. This allows the base mechanism and its associated arch to be anchored into position.

Figure 10:
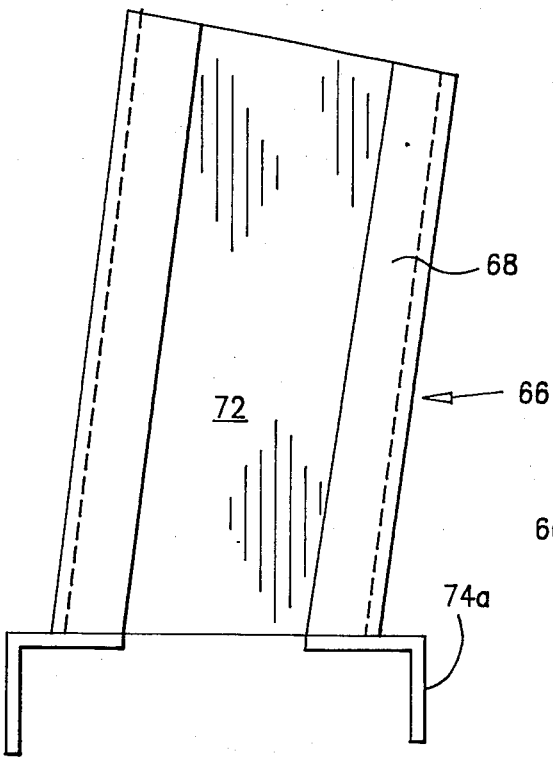
FIGS. 10–12 are enlarged side, front and end elevation views of one of the connectors used to mount the lower end of an arch to a corresponding base.
Figure 11:
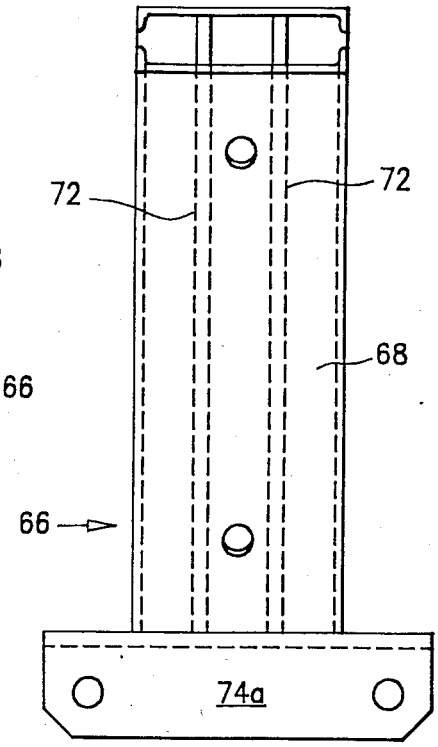
Figure 12:
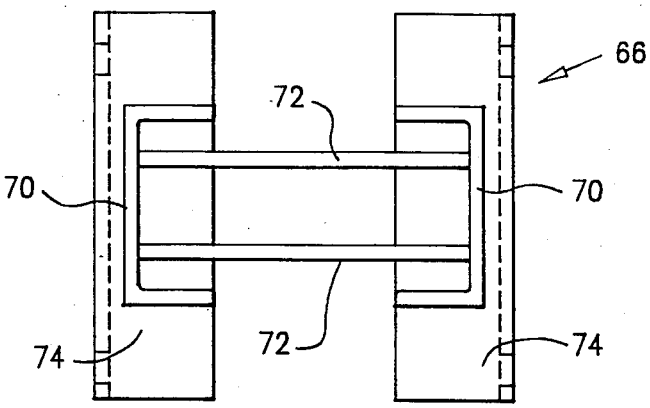

FIGS. 10–12 illustrate the configuration of a connector 66 used to mount the lower end of an arch to a corresponding base mechanism. The connector includes an upstanding member 68 insertable into the box beam 18 (FIG. 2) which forms the lower end of an arch 12. Referring again to FIG. 12, the upstanding member includes a pair of opposing U-shaped metal beams 70 welded to the opposite ends of a pair of parallel metal plates 72. The lower ends of the beams 70 and plates 72 are welded at an acute angle to metal brackets 74. The brackets 74 have downwardly extending flanges **74*a* which are spaced apart a sufficient distance so that they can fit within and overlap the upstanding flanges 48*a* of a corresponding base mechanism. The positions of the flanges 74*a* are illustrated in phantom lines in FIG. 9. Thus the flanges 74*a* of the connector 66 are positioned between the ends of the rollers 54 and the flanges of the base mechanism 36. As illustrated in FIG. 11, the flanges 74*a* have holes 76 therethrough which align with the holes 52 (FIG. 7) in the flanges 48*a* for receiving the bolts 56 therethrough. Bolts 78 (FIG. 3) extend through corresponding holes in the connector and beam segment 18** for rigidly securing the two together.

Each fabric panel 14 (FIG. 6) has a pair of generally arcuate lines 80 connected to corresponding opposite end portions of the panel so that opposite ends of the lines terminate adjacent the lower ends of the corresponding adjacent pair of arches 12. Each line 80 may comprise a stranded three-sixteenths inch stainless steel cable which is heat sealed to the corresponding arcuate longitudinal edge of a PVC fabric panel along the entire length of the panel edge. The ends of the cable 80 are threaded through the apertures 50 (FIG. 8) in the flanges **46*a* of their corresponding base mechanisms, and around respective rollers 54 thereof so that they change direction from vertical to horizontal. The ends of the cable 80 are long enough so that they can be connected and pulled together by a manual winch 82**.

Both of the cables 80 for a given panel are simultaneously winched by workmen on either side of the building to thereby transversely tension the panel. This tightens the fabric and depresses the intermediate portions of the panel between the two arches, making the panel upwardly concave. The result is a substantially wrinkle free, inwardly curved, taught fabric panel. The panel is less susceptible to vibration from the wind and is capable of supporting substantial loads. When all of the transverse rectangular panels are so tensioned the structure has is aesthetically pleasing. When the cables 80 have been sufficiently tightened, clamps such as 84 (FIG. 9) are bolted thereto to prevent the cables from sliding back through the flanges 46a of the base mechanisms. The panel is thereby maintained in its tightened condition. The winches 82 are disconnected and used in tightening the next panel 14. The excess ends of the cables 80 are wound up and stowed adjacent the base mechanisms 36.

The end sections 16 (FIG. 1) of fabric which form the end closures of the building structure also have arcuate cables which extend between the apexes 42 of the end sections. These cables are similarly threaded through corresponding base mechanisms, connected, and winched together to tighten the end fabric sections 16.

Having described a preferred embodiment of our building structure it should be apparent to those skilled in the art that our invention may be modified in both arrangement and detail. Therefore the protection afforded our invention should only be limited in accordance with the scope of the following claims.

We claim:

1. A building structure, comprising:

a plurality of arches each having a pair of lower ends;

means for rigidly holding the arches in longitudinally spaced, transversely extending, vertical positions;

a plurality of panels of a flexible web material each having a width corresponding to the longitudinal distance between adjacent ones of the arches and a length corresponding to the transverse edges thereof for connecting the same between a corresponding adjacent pair of the arches and a pair of lines connected to corresponding opposite end portions of the panel and extending generally arcuately between the transverse edges thereof so that the opposite ends of the lines terminate adjacent the lower ends of the corresponding adjacent pair of arches; and a plurality of base means each attached to the lower end of a corresponding one of the arches for guiding the opposite ends of each line so that they can be connected and pulled together to thereby transversely tension the panels each base means including a horizontal base plate, means for rigidly connecting a corresponding lower end of one of the arches to the base plate, a pair of rollers, means for rotatably mounting the rollers to the base plate for rotation about respective horizontal axes for each carrying thereabout one of an adjacent pair of ends of lines from an adjacent pair of panels, and clamp means for fixing the positions of lines after they have been pulled together.

2. A building structure according to claim 1 wherein each of the arches has a pair of outwardly opening slots formed in opposite sides of the arch and the means for connecting the transverse edges of the panels includes ropes attached to the transverse edges of the panels and threaded through corresponding ones of the slots.

3. A building structure according to claim 2 wherein each slot has a flared opening communicating therewith so that the rope of the corresponding transverse panel edge can be threaded into the slot through the flared opening.

4. A building structure according to claim 1 wherein a pair of panels is connected between each adjacent pair of the arches, one directly over and vertically spaced from the other.

5. A building structure according to claim 4 wherein each of the arches has first and second pairs of outwardly opening slots formed in opposite sides of the arch and the means for connecting the transverse edges of the panels includes ropes attached to the transverse edges of the panels and threaded through corresponding ones of the slots.

6. A building structure according to claim 1 wherein the base plate includes holes for receiving pins driven into the ground to fix the position of the base plate.

7. A building structure according to claim 1 wherein the rigid connecting means includes a member insertable into the corresponding lower end of the one arch and at least one bracket affixed to the member and configured for mating attachment to the base plate.

8. A building structure according to claim 7 wherein the blase plate includes at least one flange that mates with the bracket.

9. A building structure according to claim 1 wherein the means for rigidly connecting the corresponding lower end of one of the arches to the base plate includes a first pair of upstanding opposing flanges connected to the base plate, the means for rotatably mounting the rollers extends between the first pair of flanges, and the clamp means includes a second pair of upstanding opposing flanges connected to the base plate on corresponding portions of the plate adjacent the rollers, each of the second flanges having an aperture through which a corresponding one of the pair of lines extends, the clamp means further including a pair of clamps each fastened to a corresponding one of the pair of line ends on an outer side of its corresponding one of the second flanges and sized larger than the aperture to prevent the clamp from being drawn through the aperture.

* * * * *

UNITED STATES PATENT AND TRADEMARK OFFICE

CERTIFICATE OF CORRECTION

PATENT NO. : 4,644,706

DATED : February 24, 1987

INVENTOR(S) : Stafford et al.

It is certified that error appears in the above-identified patent and that said Letters Patent is hereby corrected as shown below:

In Claim 1, column 4, line 57, after "corresponding to" insert - - the transverse extension of the arches, each panel having means along - -.

Signed and Sealed this

Eighteenth Day of August, 1987

*Attest:*

DONALD J. QUIGG

*Attesting Officer*

*Commissioner of Patents and Trademarks*